US012042039B2

(12) United States Patent
Simon

(10) Patent No.: US 12,042,039 B2
(45) Date of Patent: Jul. 23, 2024

(54) DEVICE WORKSTATIONS WITH MULTI-WAY LEVELING ADJUSTABILITY, ARCUATE BASE, AND ACCESSORY ATTACHMENT FEATURES

(71) Applicant: David Frederick Simon, Lakeland, FL (US)

(72) Inventor: David Frederick Simon, Lakeland, FL (US)

( * ) Notice: Subject to any disclaimer, the term of this patent is extended or adjusted under 35 U.S.C. 154(b) by 87 days.

(21) Appl. No.: 17/973,470

(22) Filed: Oct. 25, 2022

(65) Prior Publication Data

US 2024/0130519 A1 Apr. 25, 2024

(51) Int. Cl.
*A47B 23/04* (2006.01)
*A47B 13/02* (2006.01)

(52) U.S. Cl.
CPC ..... *A47B 23/046* (2013.01); *A47B 13/023* (2013.01); *A47B 2013/024* (2013.01); *A47B 2023/047* (2013.01)

(58) Field of Classification Search
CPC ..... A47B 13/023; A47B 2013/024; A47B 2013/049; A47B 2013/025; A47B 21/0314
See application file for complete search history.

(56) References Cited

U.S. PATENT DOCUMENTS

| | | | | |
|---|---|---|---|---|
| 4,863,124 | A * | 9/1989 | Ball | F16M 11/048 248/458 |
| 5,374,019 | A * | 12/1994 | Fischer | F16M 13/00 248/128 |
| 7,832,694 | B2 * | 11/2010 | German | F16M 11/42 248/129 |
| 9,073,201 | B1 * | 7/2015 | Foley | B25H 1/0007 |
| 11,129,471 | B1 * | 9/2021 | Oglesby | A47B 13/023 |
| 2007/0210222 | A1 * | 9/2007 | Fortin | A47B 21/045 248/126 |
| 2011/0232540 | A1 * | 9/2011 | Benoni | F16M 13/00 248/371 |
| 2015/0289652 | A1 * | 10/2015 | Strahinic | A47B 21/0314 211/85.8 |
| 2017/0273454 | A1 * | 9/2017 | Wiener | A47B 21/0314 |
| 2018/0042375 | A1 * | 2/2018 | Failing | A47B 21/0314 |
| 2018/0125233 | A1 * | 5/2018 | Leier | A47B 13/088 |

* cited by examiner

*Primary Examiner* — Daniel J Rohrhoff
(74) *Attorney, Agent, or Firm* — Cygnet IP Law, P.A.; Stephen W. Aycock, II

(57) ABSTRACT

Device workstations with multi-way leveling adjustability, arcuate base, and accessory attachment features are described.

19 Claims, 9 Drawing Sheets

200

700

800

900

DEVICE WORKSTATIONS WITH MULTI-WAY LEVELING ADJUSTABILITY, ARCUATE BASE, AND ACCESSORY ATTACHMENT FEATURES

FIELD

Some implementations relate generally to device workstations and support stands, and, more particularly, to device workstations with multi-way leveling adjustability, arcuate base, and accessory attachment features.

BACKGROUND

Device users may wish to use a device while sitting in a chair, on a couch, or on other furniture. The bases of some conventional device workstations may be constructed in a way that does not permit the conventional workstation to abut a chair (e.g., at a corner of the chair) so that a user may bring the workstation closer while working and have the workstation position at the corner of the chair. The workstation base also permits the workstation to be used from the front or side of a chair, or from the side of a bed.

Also, some conventional workstations may not have multi-way leveling features for leveling a laptop surface and mouse surface independently. Further, some conventional workstations may not have the ability to adjust independently along multiple axes.

Embodiments were conceived in light of the above-mentioned problems and limitations, among other things. The background description provided herein is for the purpose of generally presenting the context of the disclosure. Work of the presently named inventor(s), to the extent it is described in this background section, as well as aspects of the description that may not otherwise qualify as prior art at the time of filing, are neither expressly nor impliedly admitted as prior art against the present disclosure.

SUMMARY

Some implementations can include device workstations with multi-way leveling adjustability, arcuate base, and accessory attachment features.

Some implementations can include a device workstation comprising a base having an arcuate side with a 90 degree angle (or other angle) between distal ends of the base legs, a central support member coupled to the base, and a device support member coupled to the central support member via a connection having a downward angle (or other or no angle) from the central support member to the device support member in a direction generally toward the base. The device support member is configured to rotate about the central support member.

The device workstation can also include a device support surface configured to rotate at least partially about a first axis, a second axis, and a third axis, and an auxiliary support surface configured to rotate about a fourth axis independently from the device support surface, where the fourth axis is parallel with the second axis.

In some implementations, the base is weighted. In some implementations, the base has a plurality of wheels mounted on an underside of the base. In some implementations, the central support member can include one or more telescoping sections.

In some implementations, the device support surface is configured to support a laptop computer. In some implementations, the device support surface includes one or more retractable device stops. In some implementations, the device support surface includes a device safety strap. In some implementations, the device support surface includes a releasable tablet computer mount.

In some implementations, a mobile device attachment accessory is configured to attach to the device support surface and to hold a mobile device. In some implementations, the central support member is mounted adjacent to an apex of a curve of the arcuate side of the base. In some implementations, the auxiliary support surface is configured to support a computer mouse.

DETAILED DESCRIPTION

Figure 1:
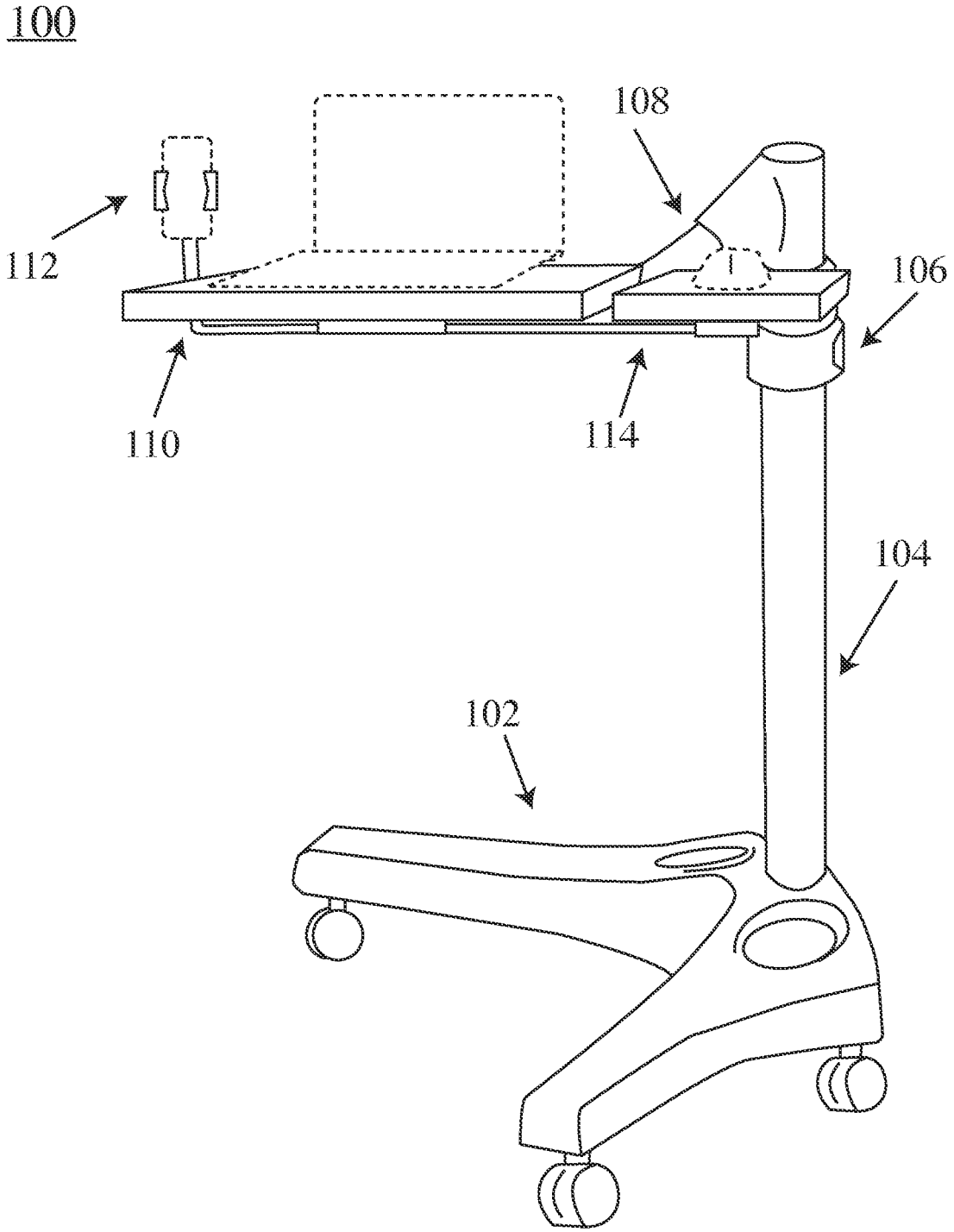
FIG. 1 is a diagram showing an example device workstation having a device support surface, an auxiliary support surface and a mobile device support in accordance with some implementations.
Figure 2:
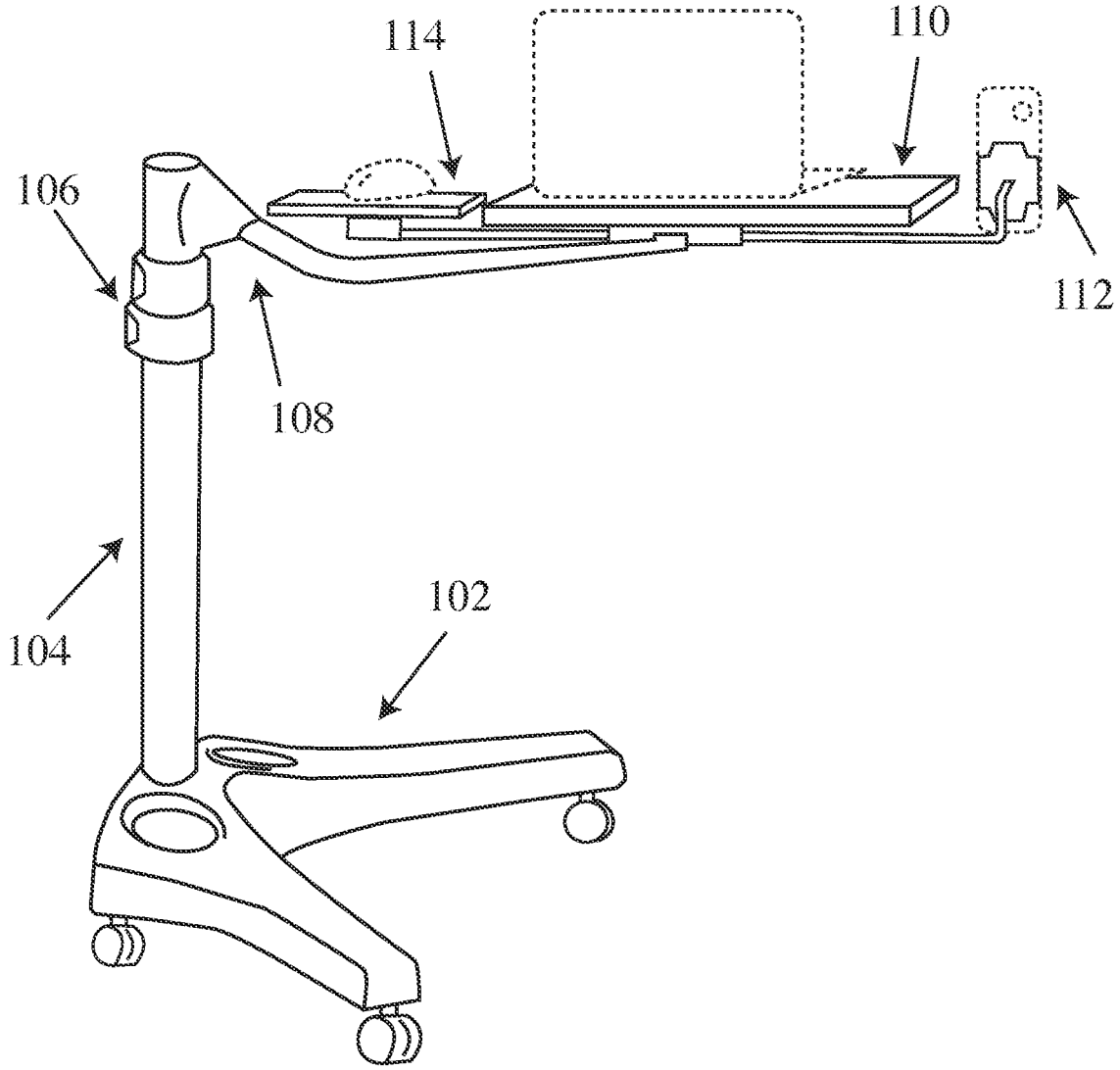
FIG. 2 is a diagram showing a backside view of an example device workstation having a device support surface, an auxiliary support surface and a mobile device support in accordance with some implementations.

FIGS. 1 and 2 are diagrams showing an example device workstation 100 having a device support surface 110, an auxiliary support surface 114 and a mobile device support 112 in accordance with some implementations. The device workstation 100 includes a base 102 having an arcuate side constructed to permit the base to abut the corner of a piece of furniture such as a chair, couch, or bed. The base 102 can be weighted to provide stability and can also include wheels mounted on an underside of the base to permit the base to be moved easily on a floor surface. Extending from the base is a central support member 104 that can include one or more telescoping sections 106. The central support member 104 is coupled to the base 102 and to a device support member 108 via a downward angle connection piece that extends from the central support member 104 toward the device support member 108 in a direction toward the base 102. It will be appreciated that the connection piece between the central support member 104 and the device support member 108 can be any suitable angle or not angled. In some implementations, the device support member is coupled to the central support member via a slidable connection that is configured to slide up and down the central support and lock in place at a given position. Some implementations can include a plurality of device support members slidably engaged with the central support member and configured to slide up and down the central support member in order to permit multiple device support surfaces to be positioned around the central support member.

The device support member is coupled to the device support surface 110. The auxiliary support surface 114 and the mobile device support 112 are each coupled to the device support surface and are each independently rotatable about an axis in line with the connection to the device support surface. In some implementations, the device support surface 110, the auxiliary support surface 114 and the mobile device support 112 are all connected to a bracket that controls the interaction of all three members. The bracket is fitted with two accessory sockets. Accessories such as the auxiliary support surface and the mobile phone support can be fixed to the bracket in any combination. That is, one of each accessory, or two auxiliary support surfaces and no phone support, or any other combination. Either accessory can be fixed to the right or left side of the bracket and therefore the desktop.

Figure 3:
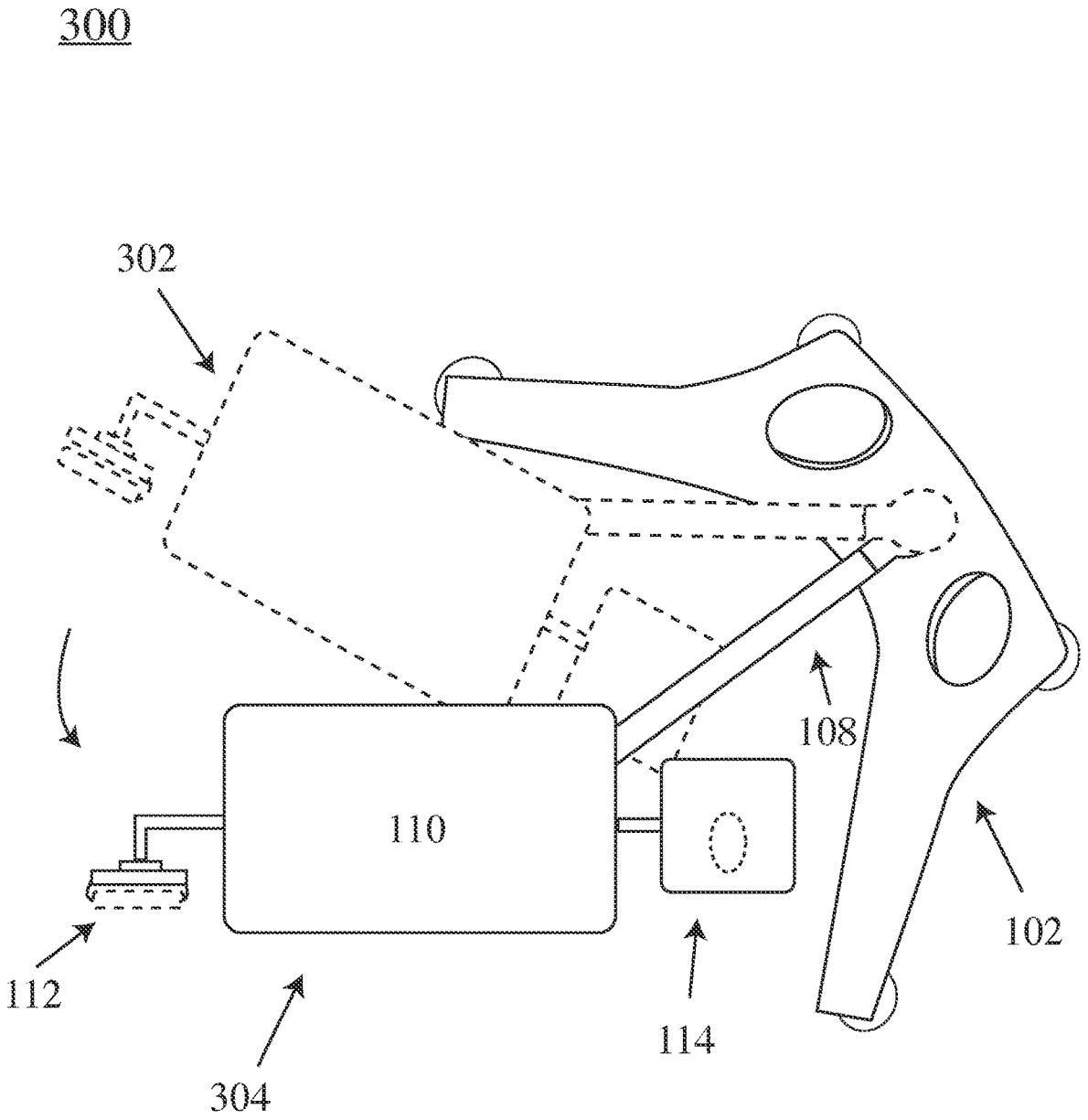
FIG. 3 is a diagram showing a top view of an example device workstation having a device support surface, an auxiliary support surface and a mobile device support, in transitional rotation about a central support member in accordance with some implementations.

FIG. 3 is a diagram showing a top view of an example device workstation 300 having a device support surface, an auxiliary support surface and a mobile device support, in transitional rotation via the device support member 108 from a first position 302 (e.g., away from the user) to a second position 304 (toward the user) about the central support member 104 in accordance with some implementations. This permits the support surfaces to be moved toward and away from a user at an angle that is convenient for each position.

Figure 4:
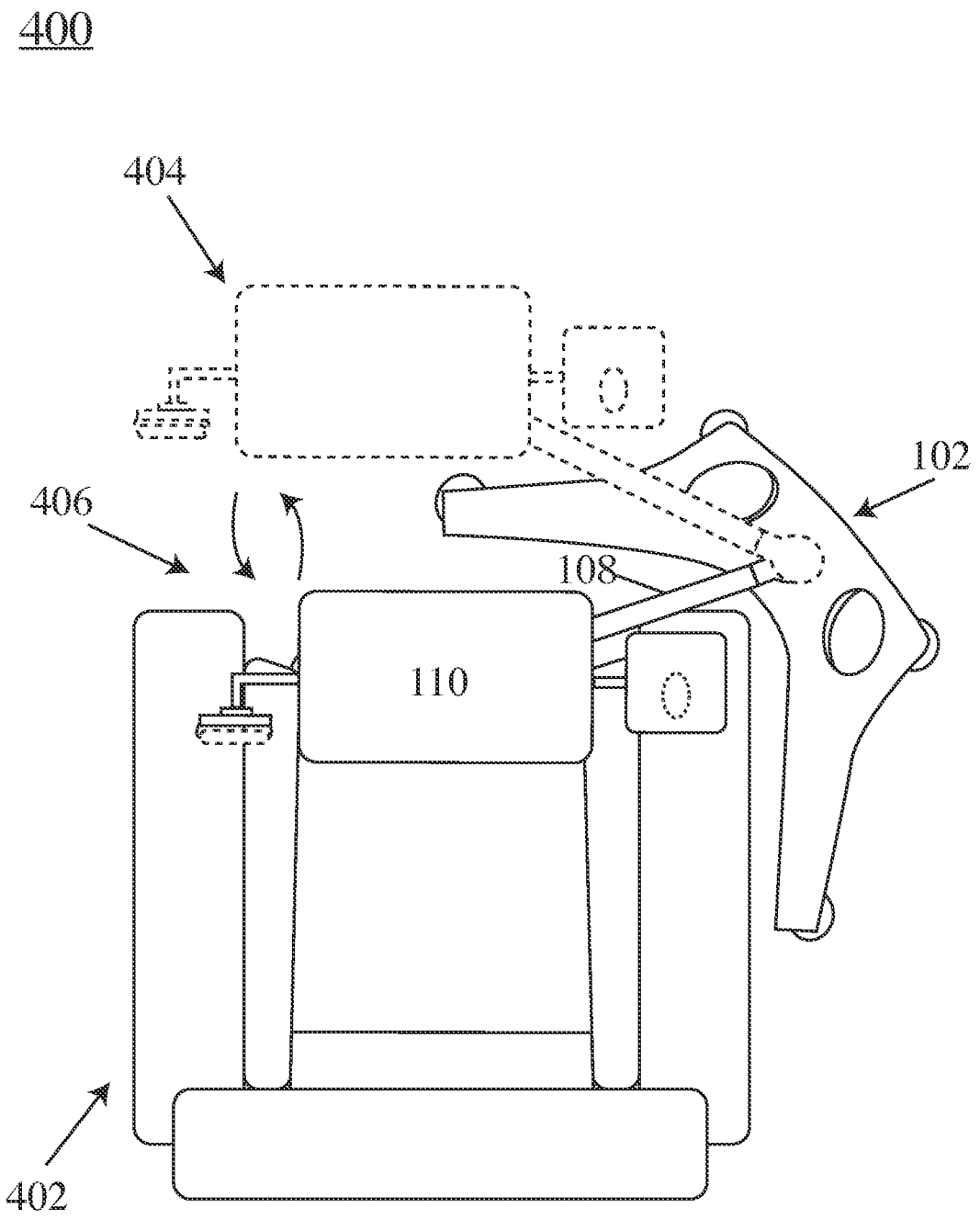
FIG. 4 is a diagram showing a top view of an example device workstation abutting a chair via the arcuate base side and having a device support surface, an auxiliary support surface and a mobile device support, wherein the support surfaces are in transitional rotation about a central support member in accordance with some implementations.

FIG. 4 is a diagram showing a top view of an example device workstation 400 abutting a chair 402 via the arcuate base 102 side and having a device support surface, an auxiliary support surface and a mobile device support, wherein the support surfaces are in transitional rotation from a first position 404 (e.g., away from the chair/user) to a second position (e.g., toward the chair/user) about a central support member in accordance with some implementations. The combination of the arcuate base side that can abut the chair 402 and the ability to transition from 404 to 406, and vice versa, permits the user to have the device workstation conveniently positioned near the chair 402 and for the support surfaces to be moved toward and away from a user at an angle that is convenient for each position.

Figure 5:
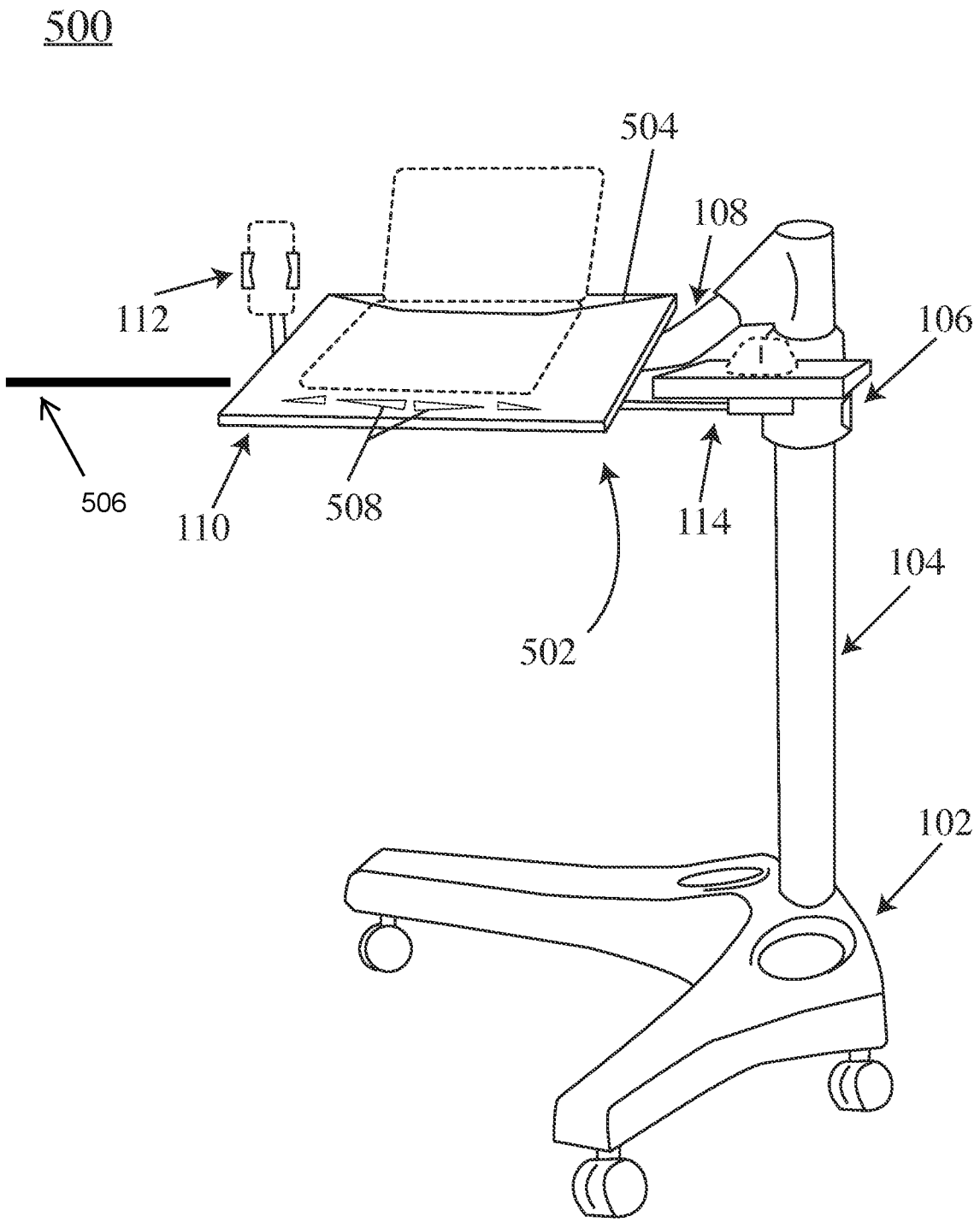
FIG. 5 is a diagram showing a top view of an example device workstation having a device support surface, an auxiliary support surface and a mobile device support, in transitional rotation about a first axis in accordance with some implementations.

FIG. 5 is a diagram showing a top view of an example device workstation 500 having a device support surface 110, an auxiliary support surface 114 and a mobile device support 112, in transitional rotation 502 about a first axis 506 (e.g., "tilt") that is in alignment with the bracket between the device support surface 110 and each of the auxiliary support surface 114 and the mobile device support 112. FIG. 5 also shows the device support surface 110 includes one or more retractable device stops 508 to help prevent a device (e.g., a laptop computer) from sliding off the device support surface and a device safety strap 504 to help secure a device such as a laptop computer to the device support surface. It is important to note that in FIG. 5, when the device support surface 110 rotates about the first axis, the auxiliary support surface 114 and the mobile device support 112 remain independent of the rotation of the device support surface so, for example, the auxiliary support surface 114 can remain level for the operation of a mouse. The first axis, or tilt axis, permits the desktop to rotate 180 degrees about a typically horizontal axis. The desktop is not always parallel to the horizon. It can tilt to provide a more comfortable angle for typing on a laptop. Furthermore, tilting provides a comfortable angle for viewing a tablet that is placed on the desktop. While tilted, the adjustable stops provide reaction forces due to gravity to retain the tablet (or book, or sketchpad, or other documents).

Figure 6:
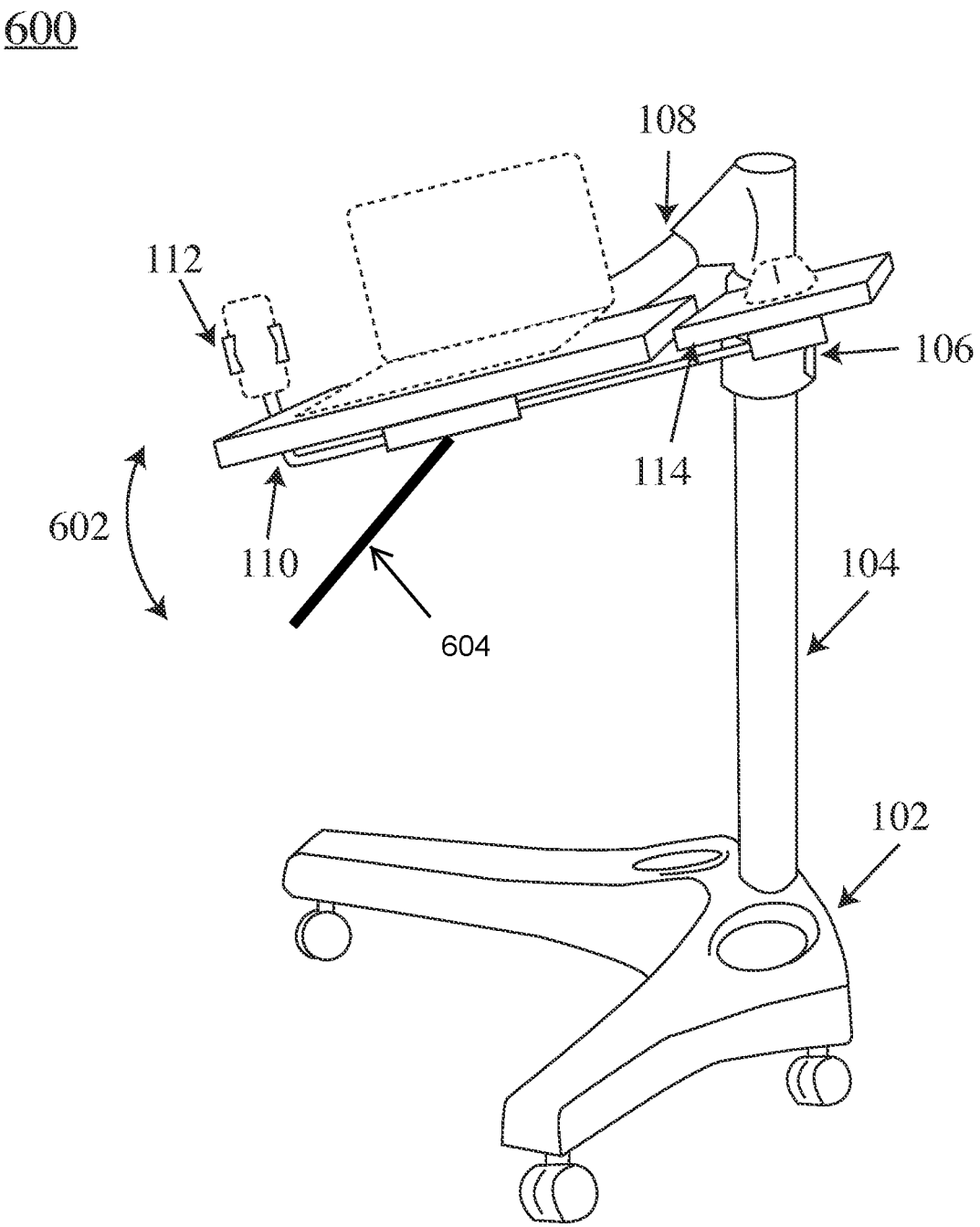
FIG. 6 is a diagram showing a side view of an example device workstation having a device support surface, an auxiliary support surface and a mobile device support, in transitional rotation about a second axis in accordance with some implementations.

FIG. 6 is a diagram showing a side view of an example device workstation 600 having a device support surface, an auxiliary support surface and a mobile device support, in transitional rotation 602 about a second axis 604 in accordance with some implementations. It is important to note that FIG. 6 shows that when the device support surface is rotated about the second axis 602 the auxiliary support surface 114 and the mobile device support 112 rotate as well as one unit.

Figure 7:
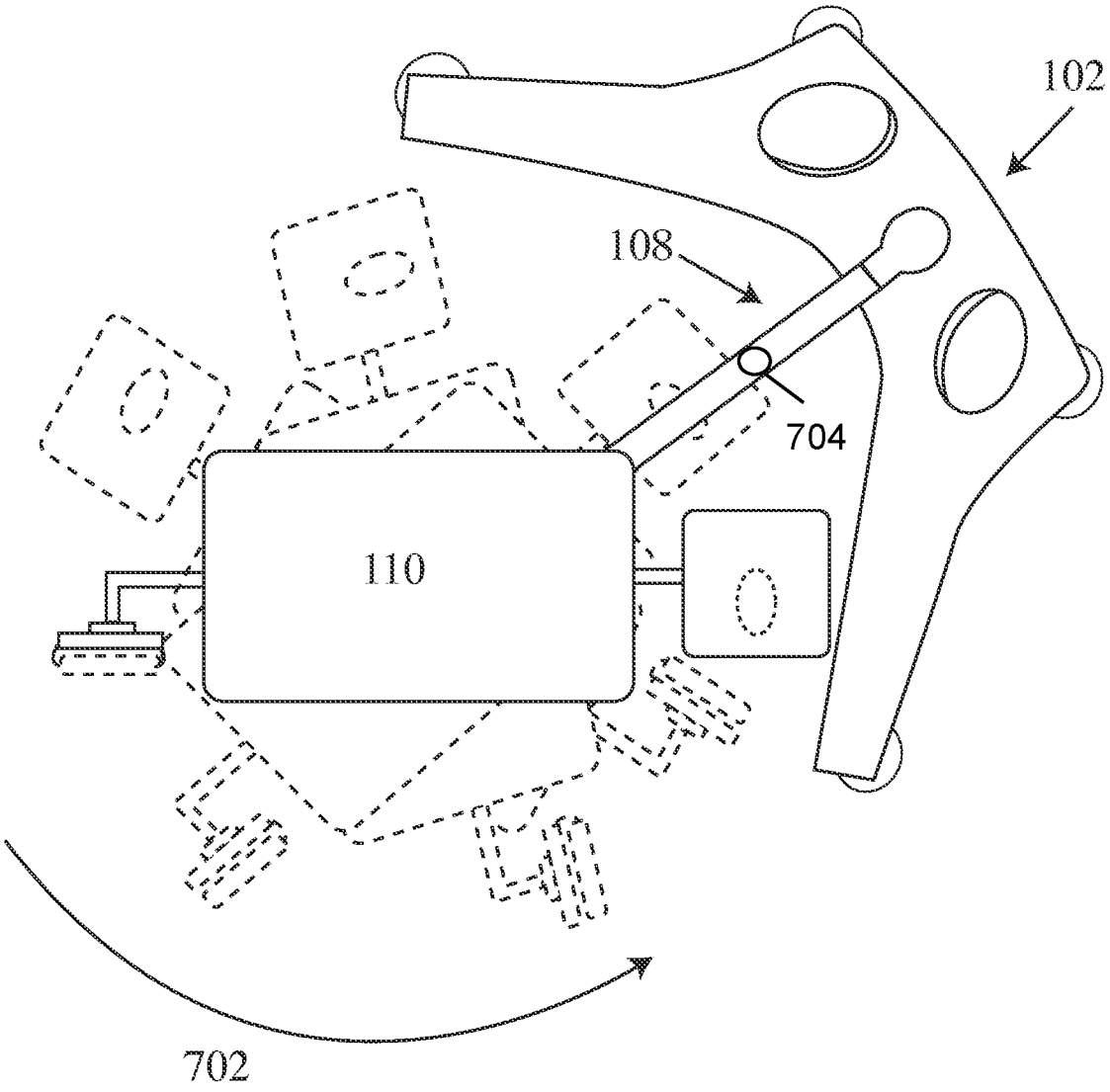
FIG. 7 is a diagram showing a top view of an example device workstation having a device support surface, an auxiliary support surface and a mobile device support, in transitional rotation about a third axis in accordance with some implementations.

FIG. 7 is a diagram showing a top view of an example device workstation having a device support surface, an auxiliary support surface and a mobile device support, in transitional rotation about a third axis 702 (running through the page in the center of the device support surface 1110) in accordance with some implementations. It is important to note that FIG. 7 shows that when the device support surface is rotated about the third axis the auxiliary support surface 114 and the mobile device support 112 rotate as well as one unit. Further, the rotation about this third axis and about the central support member provides an ability for the device workstation to extend from either the left or right side of furniture, whichever is most convenient for a user. FIG. 7 also shows an optional second rotational member (e.g., a rotational hinge) disposed on the device support are to provide an additional degree of rotation in the same plane as the rotation about the central support member.

Figure 8:
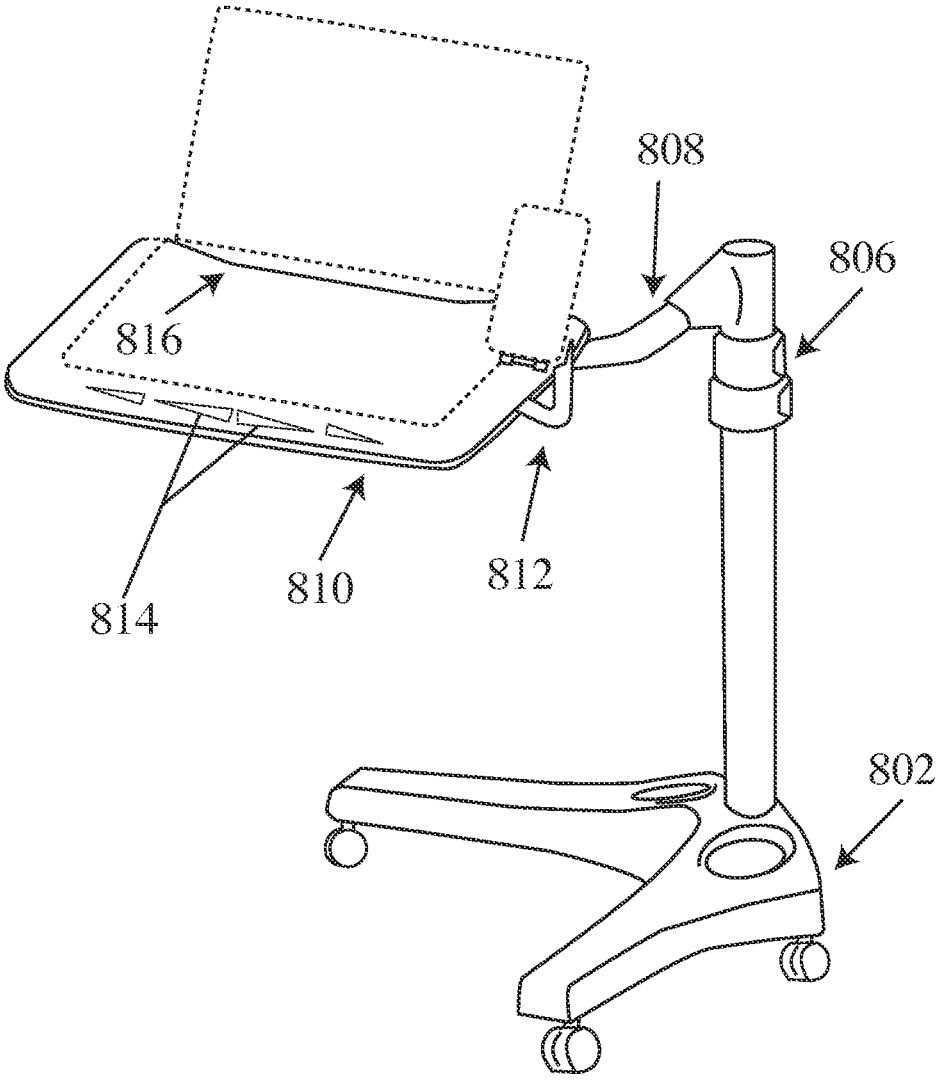
FIG. 8 is a diagram showing an example device workstation having a laptop device support surface and a mobile device support in accordance with some implementations.

FIG. 8 is a diagram showing an example device workstation 800 having a laptop device support surface 810 with device stops 814 to help prevent a device (e.g., a laptop computer) from sliding off the device support surface and a device safety strap 816 to help secure a device such as a laptop computer to the device support surface. The workstation 800 also includes a mobile device support 812. The workstation 800 includes a base 802, a central support member with telescoping sections 806, and a device support member 808 (e.g., similar to that described above for 100).

Figure 9:
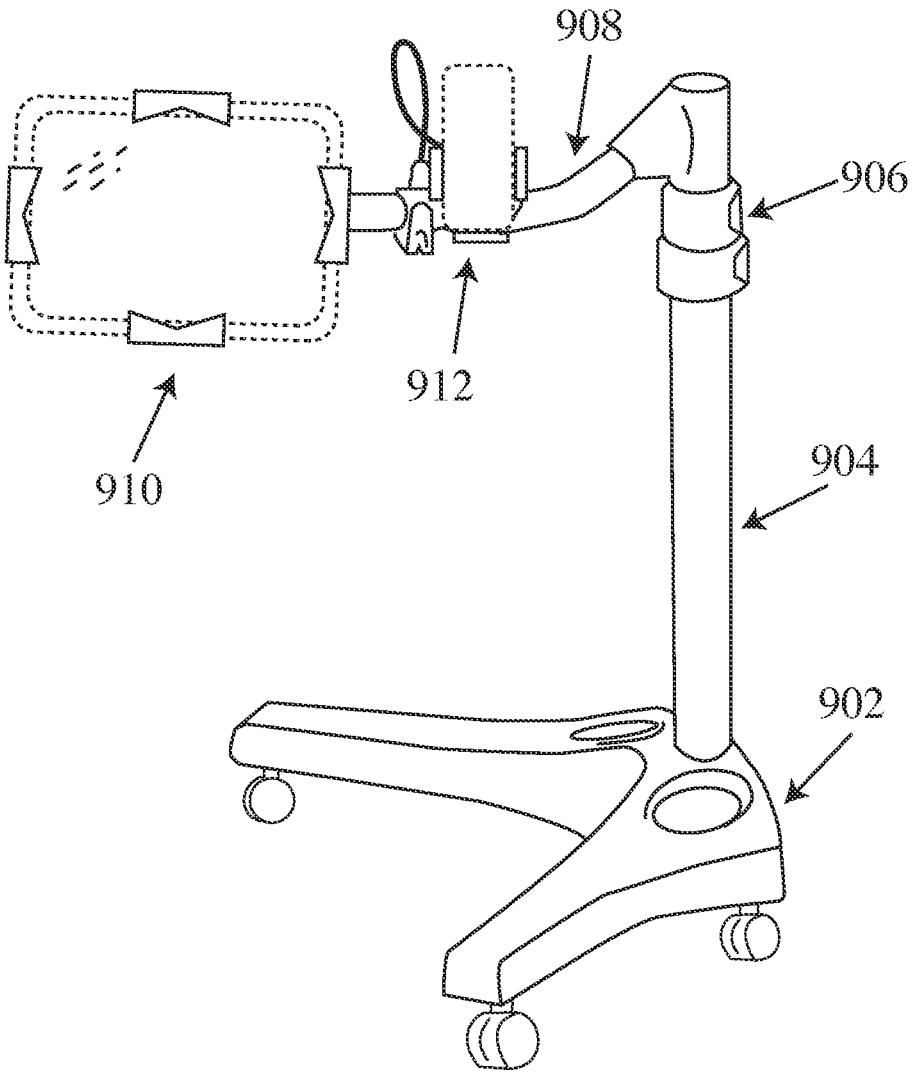
FIG. 9 is a diagram showing an example device workstation having a tablet device support surface and a mobile device support in accordance with some implementations.

FIG. 9 is a diagram showing an example device workstation 900 having a tablet device support surface and a mobile device support in accordance with some implementations. The workstation 900 also includes a mobile device support 912. The workstation 900 includes a base 902, a central support member 904, telescoping members 906, and a device support member 908 (e.g., similar to that described above for 100). However, in the case of workstation 900, the mobile phone support attaches to the stand differently than in workstation 800. With workstation 900, the mobile phone support clamps onto the horizontal arm 908.

While some example implementations have been described in terms of a general embodiment with several specific example modifications, it is recognized that other modifications and variations of the embodiments described above are within the spirit and scope of the disclosed subject matter. Applicant intends to embrace any and all such modifications, variations and embodiments.

What is claimed is:

1. A device workstation comprising:

a base having an arcuate side;

a central support member coupled to the base;

a device support member coupled to the central support member via a connection having an angle from the central support member to the device support member in a direction generally toward the base, wherein the device support member is configured to rotate about the central support member;

a device support surface coupled to the device support member via a bracket and configured to rotate at least partially about a first axis, a second axis, and a third axis; and an auxiliary support surface coupled to an accessory port of the bracket and configured to rotate about a fourth axis independently from the device support surface, where the fourth axis is parallel with the first axis.

2. The device workstation of claim 1, wherein the base is weighted.

3. The device workstation of claim 1, wherein the base has a plurality of wheels mounted on an underside of the base.

4. The device workstation of claim 1, wherein the central support member includes one or more telescoping sections.

5. The device workstation of claim 1, wherein the device support surface is configured to support a laptop computer.

6. The device workstation of claim 5, wherein the device support surface includes one or more retractable device stops.

7. The device workstation of claim 1, wherein the device support surface includes a device safety strap.

8. The device workstation of claim 1, wherein the device support surface includes a tablet computer mount to releasably hold a tablet device.

9. The device workstation of claim 1, further comprising a mobile device attachment accessory configured to attach to the bracket and to hold a mobile device.

10. The device workstation of claim 9, wherein the bracket is configured to releasably and interchangeably receive one or more auxiliary support surfaces and one or more mobile device attachment accessories.

11. The device workstation of claim 9, wherein rotation about the third axis permits the device workstation to operate on a left side or a right side of a piece of furniture.

12. The device workstation of claim 1, wherein the central support member is mounted adjacent an apex of a curve of the arcuate side of the base.

13. The device workstation of claim 1, wherein the auxiliary support surface is configured to support a computer mouse.

14. The device workstation of claim 1, wherein the device support member is coupled to the central support member via a slidable connection that is configured to slide up and down the central support and lock in place at a given position.

15. The device workstation of claim 14, further comprising a plurality of device support members slidably engaged with the central support member and configured to slide up and down the central support member in order to permit multiple device support surfaces to be positioned around the central support member.

16. A device workstation comprising:

a device support member coupled to a central support member via a connection having an angle from the central support member to the device support member in a direction generally toward a base, wherein the device support member is configured to rotate about the central support member;

a device support surface coupled to the device support member via a bracket and configured to rotate at least partially about the bracket; and an auxiliary support surface coupled the bracket, wherein the auxiliary support surface rotates about the bracket and the central support member along with the device support surface.

17. The device workstation of claim 16, wherein the auxiliary support surface is configured to rotate about a fourth axis independently from the device support surface, where the fourth axis is parallel with a first axis.

18. The device workstation of claim 16, wherein the device support member includes an additional rotational member disposed between the central support and the device support surface, such that the device support surface and the auxiliary support surface is configured to rotate at two points about the central axis on the device support member and is configured to rotate about another point at the bracket.

19. A device workstation comprising:

a device support member coupled to a central support member via a connection having an angle from the central support member to the device support member in a direction generally toward a base;

a device support surface coupled to the device support member via a bracket and configured to rotate at least partially about a first axis; and an auxiliary support surface coupled to an accessory port of the bracket and configured to rotate about a fourth axis independently from the device support surface, where the fourth axis is parallel with the first axis.

* * * * *